US011571779B2

(12) United States Patent
Greenslet et al.

(10) Patent No.: US 11,571,779 B2
(45) Date of Patent: Feb. 7, 2023

(54) MAGNETIC-FIELD-GUIDANCE SYSTEM

(71) Applicant: University of Florida Research Foundation, Incorporated, Gainesville, FL (US)

(72) Inventors: Hitomi Greenslet, Gainesville, FL (US); Razvan Vesa, Jacksonville, FL (US)

(73) Assignee: University of Florida Research Foundation, Incorporated, Gainesville, FL (US)

( * ) Notice: Subject to any disclaimer, the term of this patent is extended or adjusted under 35 U.S.C. 154(b) by 733 days.

(21) Appl. No.: 16/431,894

(22) Filed: Jun. 5, 2019

(65) Prior Publication Data

US 2019/0389025 A1 Dec. 26, 2019

Related U.S. Application Data

(60) Provisional application No. 62/687,949, filed on Jun. 21, 2018.

(51) Int. Cl.

| | |
|---|---|
| ***B24B 1/00*** | (2006.01) |
| ***B24B 11/02*** | (2006.01) |
| ***B24C 5/08*** | (2006.01) |

(52) U.S. Cl.

CPC ..... *B24B 1/005* (2013.01); *B24B 11/02* (2013.01); *B24C 5/08* (2013.01)

(58) Field of Classification Search

CPC ..... B24B 1/005; B24B 11/02; B24B 31/006; B24B 31/102; B24B 31/112

(Continued)

(56) References Cited

U.S. PATENT DOCUMENTS 2,591,083 A * 4/1952 Maier ..... B24B 31/06 451/910

4,294,424 A 10/1981 Teissier (Continued)

FOREIGN PATENT DOCUMENTS

CN 104858725 A * 8/2015 ..... B24B 1/005

WO WO-2011162893 A2 * 12/2011 ..... B24B 1/005

WO WO-2015/152062 A1 10/2015

OTHER PUBLICATIONS

Wang, CN 104858725 machine translation, Aug. 26, 2015 (Year: 2015).*

(Continued)

*Primary Examiner* — Orlando E Aviles
*Assistant Examiner* — Marcel T Dion
(74) *Attorney, Agent, or Firm* — Alston & Bird LLP

(57) ABSTRACT

A magnetic-field-guidance system and methods of finishing a workpiece using a magnetic-field-guidance system are provided. The magnetic-field-guidance system comprises a workpiece holder, one or more tooling magnets each comprising a finishing tip, and one or more flexible bags containing magnetic media. The workpiece holder is configured to (a) be secured to a base and (b) secure a workpiece relative to the base. The flexible bag(s) are configured to be disposed on the opposite side and/or same side of the workpiece relative to the one or more tooling magnets. In collaboration with the tooling magnets, the magnetic media contained with the flexible bag(s) direct a magnetic field which thereby guides a magnetic-abrasive slurry to finish the workpiece using Magnetic Abrasive Finishing (MAF).

14 Claims, 6 Drawing Sheets

(58) Field of Classification Search
USPC ..... 451/35, 36, 104, 113
See application file for complete search history.

(56) References Cited

U.S. PATENT DOCUMENTS

| | | | | |
|---|---|---|---|---|
| 4,306,386 | A * | 12/1981 | Sakulevich | B24B 1/005 451/36 |
| 5,076,026 | A * | 12/1991 | Mizuguchi | B24B 13/00 451/36 |
| 5,449,313 | A * | 9/1995 | Kordonsky | B82Y 30/00 451/36 |
| 5,795,212 | A * | 8/1998 | Jacobs | H01F 1/447 451/36 |
| 6,358,118 | B1 * | 3/2002 | Boehm | B24B 37/20 451/24 |
| 6,436,828 | B1 * | 8/2002 | Chen | B24B 1/005 438/692 |
| 7,033,251 | B2 * | 4/2006 | Elledge | B24B 37/30 451/41 |
| 8,882,165 | B2 | 11/2014 | Lipson et al. | |
| 2010/0054903 | A1 | 3/2010 | Jones et al. | |
| 2015/0017882 | A1 * | 1/2015 | Greenslet | B23Q 17/09 451/36 |
| 2016/0052147 | A1 | 2/2016 | Spicer et al. | |
| 2019/0270175 | A1 * | 9/2019 | Radnezhad | B24B 29/005 |

OTHER PUBLICATIONS

Guizzo, *Robotic Gripper Made From Coffee-Filled Ballon Picks Up Anything*, IEEE Spectrum, Oct. 29, 2010, [online], [retrieved from the Internet May 16, 2017] <URL: https://spectrum.ieee.org/automaton/robotics/industrial-robots/universal-jamming-gripper>, pp. 1-5.

Liszewski, *This Robot Arm's Water Ballon Gripper Is Inspired By A Gecko's Tongue*, Gizmodo, Mar. 27, 2015, [online], [retireved from the Inernet Jun. 19, 2019], <URL: https://gizmodo.com/this-robot-arms-water-balloon-gripper-is-inspired-by-a-1694087497>, (4 pages).

* cited by examiner

MAGNETIC-FIELD-GUIDANCE SYSTEM

CROSS-REFERENCE TO RELATED APPLICATIONS

This application claims priority to and the benefit of U.S. Provisional Application No. 62/687,949, filed Jun. 21, 2018; the contents of which as are hereby incorporated by reference in their entirety.

BACKGROUND

Freeform surfaces, such as the femoral components of knee prostheses, present a significant challenge in manufacturing. The finishing of such surfaces is often performed manually, which leads to surface finish variations. In the case of knee prostheses, this can also be a factor leading to accelerated wear of the polyethylene tibial component. The feasibility of Magnetic Abrasive Finishing (MAF) to finish knee prostheses and other freeform components has been demonstrated, and the process has accordingly attracted applications in medical industries. However, MAF has not seen widespread practical use because of the long lead time required to prepare a custom magnetic-field-guidance system that generates a magnetic field at the finishing area needed for finishing each of a variety of workpiece geometries.

Accordingly, there is a need in the art for improved methods, apparatuses, systems, computer program products, and/or the like to prepare a magnetic-field guidance system for efficient use of MAF in finishing of freeform surfaces.

BRIEF SUMMARY

Example embodiments provide methods, apparatuses, systems, and computer program products for a magnetic-field-guidance system for use in finishing freeform workpieces using MAF. For example, the magnetic-field-guidance system comprises a flexible bag filled with magnetic media (e.g., particles, flakes, rings (loose or linked), spheres, short wires, pins, and/or the like). In various embodiments, the magnetic-field-guidance system comprises a workpiece holder or jig configured for holding a workpiece; a flexible bag configured for manipulating, guiding, and influencing the magnetic field in the vicinity of the workpiece; one or more tooling magnets; and a finishing tip. The finishing tip is configured to guide an appropriate magnetic field for MAF. In various embodiments, the flexible bag may or may not contact the workpiece. In various embodiments, the magnetic media enclosed within the flexible bag(s) manipulate, guide, and/or influence a magnetic field that is generated by the tooling magnet(s). The magnetic field can then be used, with the finishing tip attached to each tooling magnet, to efficiently finish freeform workpieces.

In various embodiments, the flexibility of the bag allows the system to reconfigure and/or be reconfigured and be applied to a variety of workpiece geometries. The workpieces can be geometrically different from one another, which currently requires a custom magnetic-field-guidance system for each individual workpiece. Therefore, the flexibility of the bag creates the potential to drastically shorten lead time, since there is no need to design and fabricate a magnetic-field-guidance system matching each workpiece. In addition, the magnetic field at the finishing area can be adjusted by changing the magnetic media (materials, geometry, size, and amount) contained within the flexible bag and/or the positional arrangement between the flexible bag(s), the tooling magnet(s), the finishing tip(s), and the workpiece. The application of various embodiments of the magnetic-field-guidance system is not limited to the surface finishing of knee prostheses; it also can be used for dies, molds, optics, and other complex components.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF EXAMPLE EMBODIMENTS

Figure 1:
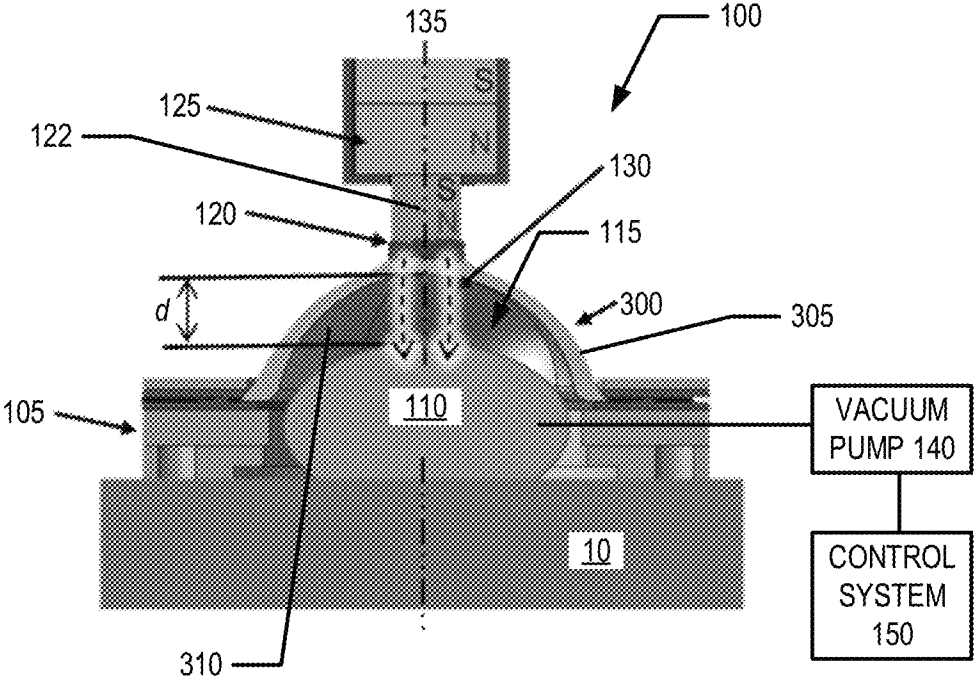
FIG. 1 illustrates an example system that can be used to practice embodiments of the present invention.
Figure 2:
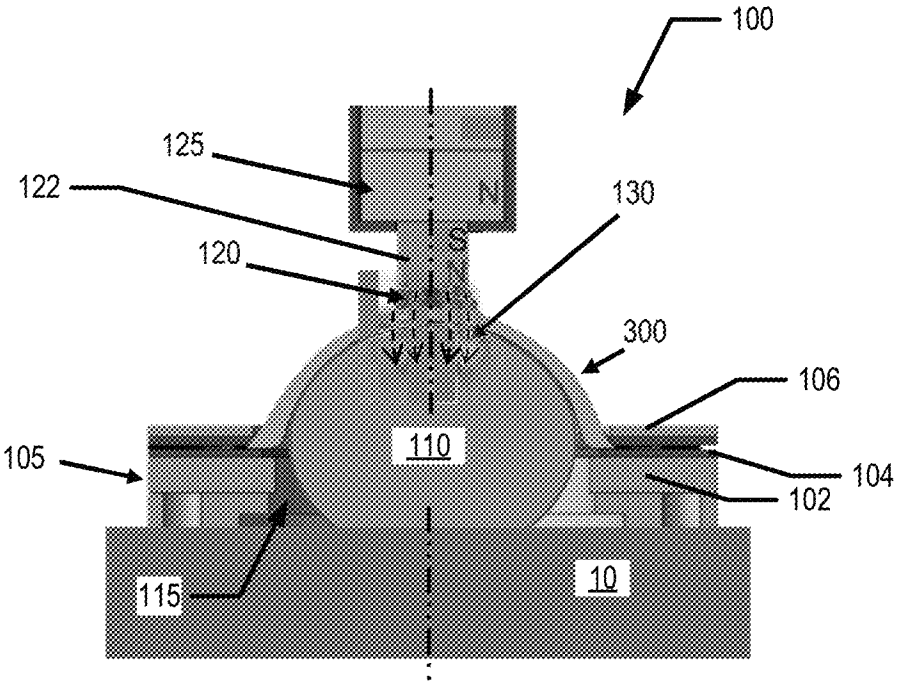
FIG. 2 illustrates another example system that can be used to practice embodiments of the present invention.
Figure 3:
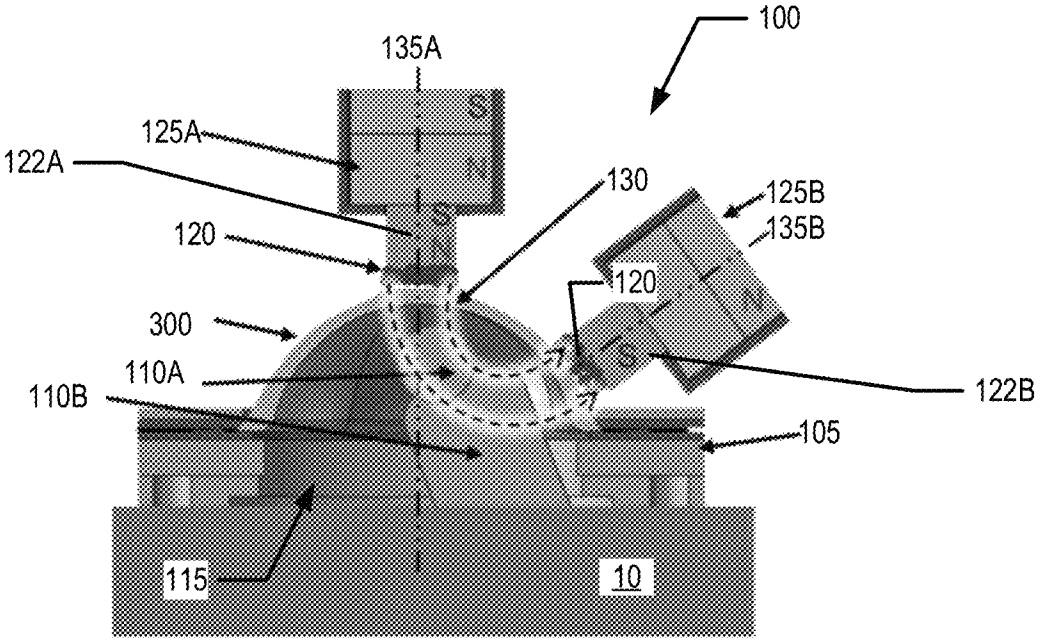
FIG. 3 illustrates another example system that can be used to practice embodiments of the present invention.
Figure 4:
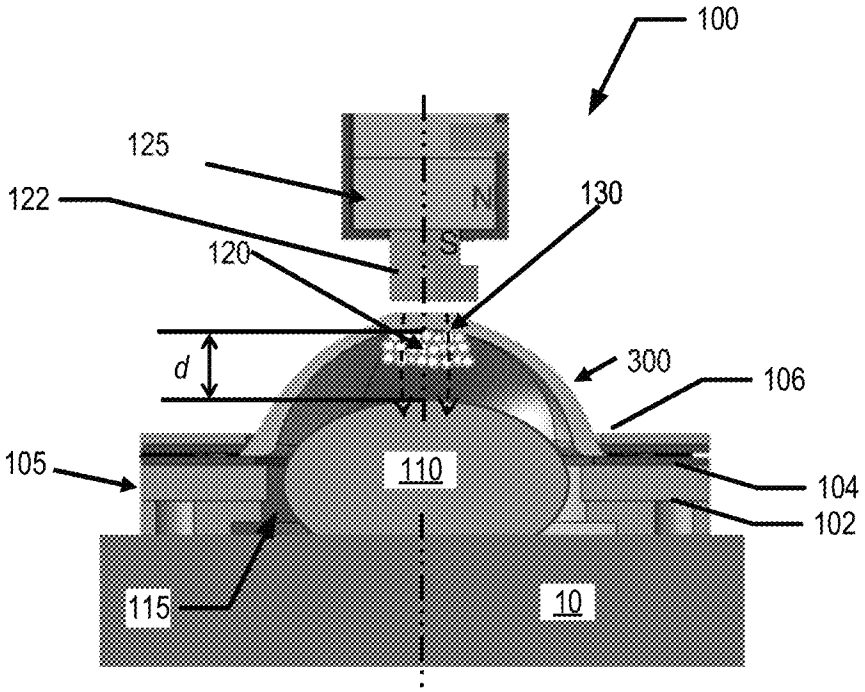
FIG. 4 illustrates another example system that can be used to practice embodiments of the present invention.

Various embodiments of the present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. The term "or" is used herein in both the alternative and conjunctive sense, unless otherwise indicated. The terms "illustrative" and "exemplary" are used to be examples with no indication of quality level. The terms "approximately" and "substantially" are used to refer to values within the corresponding engineering and/or manufacturing tolerances. Like numbers refer to like elements throughout.

I. Exemplary Magnetic-Field-Guidance System

FIGS. 1, 2, 3, 4, and 5 illustrate example magnetic-field-guidance systems that may be used for finishing a workpiece 300, according to various embodiments. In various embodiments, the magnetic-field-guidance system 100 is a workpiece finishing system. In an example embodiment, the workpiece 300 comprises a first surface 305 and/or a second surface 310. For example, one of the first surface 305 and the second surface 310 may be a concave surface and the other of the first surface 305 and the second surface 310 may be convex surface, in an example embodiment. The magnetic-field-guidance system may be configured to finish the first surface 305 and/or the second surface 310. For example, the finishing area may be located on the first surface 305 and/or the second surface 310 of the workpiece 300, as appropriate for the application of the workpiece 300.

In an example embodiment, the magnetic-field-guidance system 100 comprises a workpiece holder 105 configured to be secured to a base 10 and to secure a workpiece 300 relative to the base 10. In an example embodiment, the magnetic-field-guidance system 100 comprises one or more tooling magnets 125. Each tooling magnet 125 comprises a finishing tip 122. The finishing tip 122 can be ferromagnetic or can be a permanent magnet. The finishing tip 122 guides or creates an appropriate magnetic field for MAF and attracts a magnetic-abrasive slurry 120 to the finishing area. The finishing area can be on the same side or on the opposite side of the tooling magnet 125.

In an example embodiment, the magnetic-field-guidance system 100 comprises one or more flexible bags 110 containing magnetic media. The flexible bag 110 is configured to be disposed on an opposite side of the workpiece 300 relative to the one or more tooling magnets 125. In collaboration with the tooling magnet(s) 125 and finishing tip(s) 122, the magnetic media contained within the flexible bag 110 is configured to guide a magnetic field 130 so that it attracts the magnetic-abrasive slurry 120 in MAF to finish the workpiece 300. In various embodiments, the magnetic-abrasive slurry 120 may be applied to the finishing tip 122 or to the finishing area (e.g., located on the first surface 305 or second surface 310 of the workpiece 300). In an example embodiment, the magnetic-abrasive slurry 120 is applied to (e.g., by the finishing tip 122 and/or directly applied to) the surface of the workpiece 300 that is adjacent the tooling magnet(s) 125 and the corresponding finishing tip(s) 122. In an example embodiment, the magnetic-abrasive slurry 120 is applied to the surface of the workpiece 300 that is opposite the tooling magnet(s) 125 (e.g., the surface of the workpiece 300 facing the cavity 115).

In an example embodiment, one or more vacuum pumps 140 may be operatively connected to the flexible bags 110 such that at least one of the flexible bags 110 may be inflated and/or deflated to adjust the distance d between the flexible bag 110 and the workpiece 300. The one or more vacuum pumps 140 may work as a vacuum chuck to fix the flexible bag 110 to the base 10, or a clamping system may be introduced to fix the flexible bag 110 to the base 10. In an example embodiment, the one or more vacuum pumps 140 may be manually controlled and/or operated. In an example embodiment, the one or more vacuum pumps 140 may be controlled and/or operated by a control system 150. For example, the control system 150 may comprise computer-executable instructions for a finishing routine and may adjust the position of one or more flexible bags 110 and/or the distance d between the flexible bag 110 and the workpiece 300 in accordance with the finishing routine to provide an automated finishing of the workpiece 300. For example, the control system 150 may operate one or more vacuum pumps 140 (and/or other pumps, motors, and/or the like) to selectively adjust the volume, shape, and/or position of one or more flexible bags 110 in accordance with a finishing routine for finishing a workpiece 300.

As noted above, the magnetic-field-guidance system 100 comprises a workpiece holder 105 configured to secure a workpiece 300 relative to a base 10. In an example embodiment, the workpiece holder 105 is a jig configured to hold a variety of workpieces 300. For example, the workpiece holder 105 may be a universal jig for serial use with a variety of workpieces 300. In an example embodiment, the workpiece holder 105 comprises a peripheral support 102 defining a cavity 115 and the one or more flexible bags 110 are disposed within the cavity 115. In an example embodiment, the workpiece holder 105 comprises a seat 104 disposed at least in part on the peripheral support 102 and a clamping component 106 configured to hold the workpiece 300 engaged to the seat 104 for the finishing process.

Figure 5:
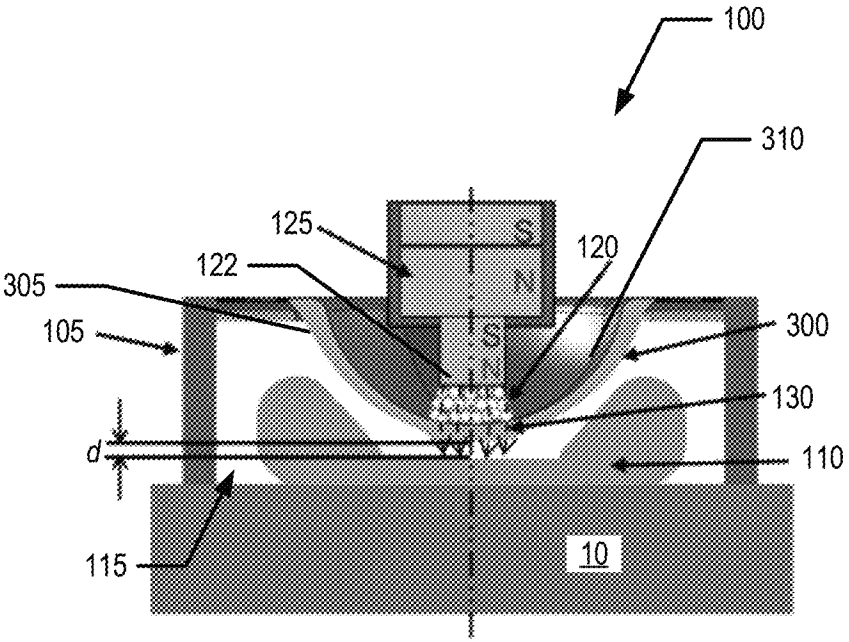
FIG. 5 illustrates another example system that can be used to practice embodiments of the present invention.

In an example embodiment, the workpiece holder 105 may be configured to secure the workpiece 300 with respect to the base 10 in a first position such that the first surface 305 of the workpiece 300 is adjacent to the finishing tip(s) 122 and the second surface 310 of the workpiece 300 is the opposite side of the finishing tip(s) 122 such that the second surface 310 defines a perimeter of the cavity 115, as shown in FIGS. 1-4. In an example embodiment, the workpiece holder 105 may be configured to secure the workpiece 300 with respect to the base 10 in a second position such that the second surface 310 of the workpiece 300 is adjacent to the finishing tip(s) 122 and the first surface 305 of the workpiece 300 is the opposite side of the finishing tip(s) 122 such that the first surface 305 defines a perimeter of the cavity 115, as shown in FIG. 5. In an example embodiment, the workpiece holder 105 may be configured to secure the workpiece 300 with respect to the base 10 in either the first or second position.

In various embodiments, the magnetic-field-guidance system 100 comprises one or more tooling magnets 125. In an example embodiment, a tooling magnet 125 has a permanent and/or adjustable magnetic moment. The tooling magnet 125 may be an electromagnet, permanent magnet, and/or the like. In various embodiments, the finishing tip 122 may be a part of a corresponding tooling magnet 125 or may be secured to a corresponding tooling magnet 125. In an example embodiment, a finishing tip 122 may be a permanent magnet or be made of a ferromagnetic material, configured to guide a magnetic field in MAF and attract a magnetic-abrasive slurry to the finishing area to finish the workpiece. In an example embodiment, the magnetic-abrasive slurry comprises a mixture of magnetic particles and abrasive particles such as diamond, aluminum oxides, silicon carbides, silica, ceria, etc. Each tooling magnet 125 defines an axis 135. The axis 135 may be defined by the local magnetic field of the tooling magnet 125 (and/or the finishing tip 122) in the absence of magnetic media contained within the flexible bag 110. In various embodiments wherein two tooling magnets 125 are used (see FIG. 3), a first tooling magnet 125A may define a first axis 135A, which is parallel to the intrinsic or induced magnetic moment of the first tooling magnet 125A, and a second tooling magnet 125B may define a second axis 135B, which is parallel to the intrinsic or induced magnetic moment of the second tooling magnet 125B. In various embodiments, the first axis 135A and the second axis 135B may be at various and/or adjustable angles with respect to one another, as appropriate for the finishing of the workpiece 300.

In various embodiments, the magnetic-field-guidance system 100 comprises one or more flexible bags 110 containing magnetic media. In various embodiments, the magnetic media comprises at least one of (a) magnetic linked rings, (b) magnetic unlinked rings, (c) magnetic spheres, (d) magnetic flakes, (e) magnetic powders, (f) magnetic short wires, (g) magnetic pins, and/or the like. In various embodiments, one or more flexible bags 110 may be disposed within the cavity 115 of the workpiece holder 105 such that the one or more flexible bags 110 are on the opposite side of the workpiece 300 relative to the one or more tooling magnets 125. In an example embodiment, two or more flexible bags 110 are used in combination. In various embodiments, each flexible bag 110 of the two or more flexible bags may have the same type and/or same combination of magnetic media therein or may have different types and/or different combinations of magnetic media.

In an example embodiment, the volume of a flexible bag 110 may be adjusted to adjust the distance d between the flexible bag 110 and the proximate surface of the workpiece 300. In an example embodiment, the position of the flexible bag 110 within the cavity 115 may be adjusted. The adjustment of the volume, shape, and/or position of one or more flexible bags 110 within the cavity 115 may affect and/or influence the magnetic field 130 in the vicinity of the workpiece 300, such that the finishing of the workpiece 300 via the magnetic-abrasive slurry 120 by the one or more tooling magnets 125 is affected and/or controlled, at least in part, via the adjustment of the one or more flexible bags 110. In various embodiments, the volume and/or shape of a flexible bag 110 may be adjusted by adding or removing air from the interior of the flexible bag 110. In an example embodiment, the volume and/or shape of the flexible bag 110 may be adjusted by adding or removing magnetic media from the flexible bag 110. In various embodiments, the volume, shape, and/or position of the one or more flexible bags 110 within the cavity 115 may be adjusted before the finishing process and/or during the finishing process (e.g., via the control system 150). In various embodiments, one or more flexible bags 110 may be disposed on the opposite side of the workpiece 300 with no cavity relative to the one or more tooling magnets 125 (e.g., such that the distance d is small or zero) for at least a portion of the finishing process. In various embodiments, the distance d between the flexible bag 110 and the proximate surface is non-zero for the entirety and/or a portion of the finishing process. For example, the flexible bag 110 and/or the magnetic media contained therein may be used to influence the magnetic field near the workpiece 300 but may not be used to mechanically support the workpiece 300, in various embodiments.

II. Exemplary Control System

Figure 6:
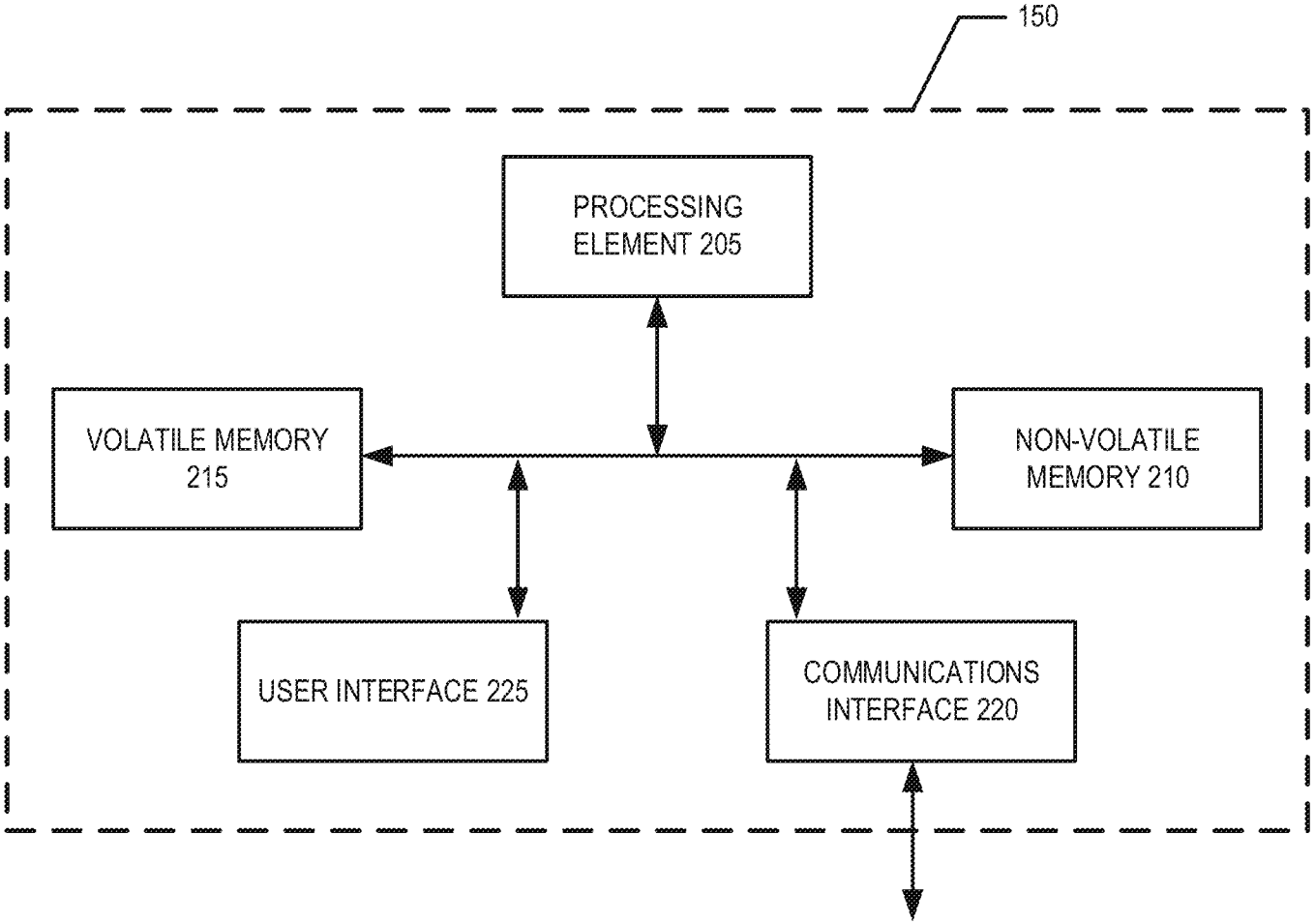
FIG. 6 is an exemplary schematic diagram of a control system according to one embodiment of the present invention.

FIG. 6 provides a schematic of a control system 150 according to one embodiment of the present invention. A control system 150 may be configured to control the vacuum pump 140 and/or one or more other elements for guiding and influencing the magnetic field in the vicinity of the workpiece 300. For example, the one or more other elements for guiding and influencing the magnetic field in the vicinity of the workpiece 300 may include a motor or other element for adjusting the shape and/or position of one or more flexible bags 110, amount of magnetic media within one or more flexible bags 110, and/or the like. In an example embodiment, the control system 150 is configured to control the vacuum pump 140 and/or one or more other elements via execution of a finishing routine to provide an automated finishing of the workpiece 300. In an example embodiment, the control system 150 may be a dedicated control system or computing entity (e.g., a desktop computer, mobile computing entity, and/or the like) configured for multiple functions.

In general, the terms computing entity, computer, entity, device, system, and/or similar words used herein interchangeably may refer to, for example, one or more computers, computing entities, desktops, mobile phones, tablets, phablets, notebooks, laptops, distributed systems, servers or server networks, blades, gateways, switches, processing devices, processing entities, relays, routers, network access points, base stations, the like, and/or any combination of devices or entities adapted to perform the functions, operations, and/or processes described herein. Such functions, operations, and/or processes may include, for example, transmitting, receiving, operating on, processing, displaying, storing, determining, creating/generating, monitoring, evaluating, comparing, and/or similar terms used herein interchangeably. In one embodiment, these functions, operations, and/or processes can be performed on information/data, content, information, and/or similar terms used herein interchangeably.

As indicated, in one embodiment, the control system 150 may also include one or more communications interfaces 220 for communicating with various computing entities, such as by communicating information/data, content, information, and/or similar terms used herein interchangeably that can be transmitted, received, operated on, processed, displayed, stored, and/or the like. For instance, the control system 150 may communicate with a vacuum pump 140, one or more computing entities, and/or the like.

As shown in FIG. 6, in one embodiment, the control system 150 may include or be in communication with one or more processing elements 205 (also referred to as processors, processing circuitry, processing device, and/or similar terms used herein interchangeably) that communicate with other elements within the control system 150 via a bus, for example. As will be understood, the processing element 205 may be embodied in a number of different ways. For example, the processing element 205 may be embodied as one or more complex programmable logic devices (CPLDs), microprocessors, multi-core processors, coprocessing entities, application-specific instruction-set processors (ASIPs), microcontrollers, and/or controllers. Further, the processing element 205 may be embodied as one or more other processing devices or circuitry. The term circuitry may refer to an entirely hardware embodiment or a combination of hardware and computer program products. Thus, the processing element 205 may be embodied as integrated circuits, application specific integrated circuits (ASICs), field programmable gate arrays (FPGAs), programmable logic arrays (PLAs), hardware accelerators, other circuitry, and/or the like. As will therefore be understood, the processing element 205 may be configured for a particular use or configured to execute instructions stored in volatile or non-volatile media or otherwise accessible to the processing element 205. As such, whether configured by hardware or computer program products, or by a combination thereof, the processing element 205 may be capable of performing steps or operations according to embodiments of the present invention when configured accordingly.

In one embodiment, the control system 150 may further include or be in communication with non-volatile media (also referred to as non-volatile storage, memory, memory storage, memory circuitry and/or similar terms used herein interchangeably). In one embodiment, the non-volatile storage or memory may include one or more non-volatile storage or memory media 210, including but not limited to hard disks, ROM, PROM, EPROM, EEPROM, flash memory, MMCs, SD memory cards, Memory Sticks, CBRAM, PRAM, FeRAM, NVRAM, MRAM, RRAM, SONOS, FJG RAM, Millipede memory, racetrack memory, and/or the like. As will be recognized, the non-volatile storage or memory media may store databases, database instances, database management systems, information/data, applications, programs, program modules, scripts, source code, object code, byte code, compiled code, interpreted code, machine code, executable instructions, and/or the like. In an example embodiment, the memory stores computer-executable instructions for performing an automated finishing process. For example, the computer-executable instructions may include instructions for controlling a vacuum pump 140, motor, and/or one or more other elements to control the magnetic field about the workpiece 300 such that the workpiece 300 may be finished using MAF. The terms database, database instance, database management system, and/or similar terms used herein interchangeably may refer to a structured collection of records or data that is stored in a computer-readable storage medium, such as via a relational database, hierarchical database, and/or network database.

In one embodiment, the control system 150 may further include or be in communication with volatile media (also referred to as volatile storage, memory, memory storage, memory circuitry and/or similar terms used herein interchangeably). In one embodiment, the volatile storage or memory may also include one or more volatile storage or memory media 215, including but not limited to RAM, DRAM, SRAM, FPM DRAM, EDO DRAM, SDRAM, DDR SDRAM, DDR2 SDRAM, DDR3 SDRAM, RDRAM, TTRAM, T-RAM, Z-RAM, RIMM, DIMM, SIMM, VRAM, cache memory, register memory, and/or the like. As will be recognized, the volatile storage or memory media may be used to store at least portions of the databases, database instances, database management systems, information/data, applications, programs, program modules, scripts, source code, object code, byte code, compiled code, interpreted code, machine code, executable instructions, and/or the like being executed by, for example, the processing element 205. Thus, the databases, database instances, database management systems, information/data, applications, programs, program modules, scripts, source code, object code, byte code, compiled code, interpreted code, machine code, executable instructions, and/or the like may be used to control certain aspects of the operation of the control system 150 with the assistance of the processing element 205 and operating system.

As indicated, in one embodiment, the control system 150 may also include one or more communications interfaces 220 for communicating with various computing entities, such as by communicating information/data, content, information, and/or similar terms used herein interchangeably that can be transmitted, received, operated on, processed, displayed, stored, and/or the like. Such communication may be executed using a wired data transmission protocol, such as fiber distributed data interface (FDDI), digital subscriber line (DSL), Ethernet, asynchronous transfer mode (ATM), frame relay, data over cable service interface specification (DOC SIS), or any other wired transmission protocol. Similarly, the control system 150 may be configured to communicate via wireless external communication networks using any of a variety of protocols, such as general packet radio service (GPRS), Universal Mobile Telecommunications System (UMTS), Code Division Multiple Access 2000 (CDMA2000), CDMA2000× (1×RTT), Wideband Code Division Multiple Access (WCDMA), Time Division-Synchronous Code Division Multiple Access (TD-SCDMA), Long Term Evolution (LTE), Evolved Universal Terrestrial Radio Access Network (E-UTRAN), Evolution-Data Optimized (EVDO), High Speed Packet Access (HSPA), High-Speed Downlink Packet Access (HSDPA), IEEE 802.11 (Wi-Fi), Wi-Fi Direct, 802.16 (WiMAX), ultra wideband (UWB), infrared (IR) protocols, near field communication (NFC) protocols, Bluetooth protocols, Wibree, Home Radio Frequency (HomeRF), Simple Wireless Abstract Protocol (SWAP), wireless universal serial bus (USB) protocols, and/or any other wireless protocol.

The control system 150 may include or be in communication with a user interface 225. In an example embodiment, the user interface 225 comprises one or more input elements, such as a keyboard input, a mouse input, a touch screen/display input, motion input, movement input, audio input, pointing device input, joystick input, keypad input, and/or the like. The user interface 225 may also include or be in communication with one or more output elements, such as audio output, video output, screen/display output, motion output, movement output, and/or the like.

As will be appreciated, one or more of the components of the control system 150 may be located remotely from other control system 150 components, such as in a distributed system. Furthermore, one or more of the components may be combined and additional components performing functions described herein may be included in the control system 150. Thus, the control system 150 can be adapted to accommodate a variety of needs and circumstances. As will be recognized, these architectures and descriptions are provided for exemplary purposes only and are not limiting to the various embodiments.

III. Computer Program Products, Methods, and Computing Entities

Embodiments of the present invention may be implemented in various ways, including as computer program products that comprise articles of manufacture. A computer program product may include a non-transitory computer-readable storage medium storing applications, programs, program modules, scripts, source code, program code, object code, byte code, compiled code, interpreted code, machine code, executable instructions, and/or the like (also referred to herein as executable instructions, instructions for execution, computer program products, program code, and/or similar terms used herein interchangeably). Such non-transitory computer-readable storage media include all computer-readable media (including volatile and non-volatile media).

In one embodiment, a non-volatile computer-readable storage medium may include a floppy disk, flexible disk, hard disk, solid-state storage (SSS) (e.g., a solid state drive (SSD), solid state card (SSC), solid state module (SSM), enterprise flash drive, magnetic tape, or any other non-transitory magnetic medium, and/or the like. A non-volatile computer-readable storage medium may also include a punch card, paper tape, optical mark sheet (or any other physical medium with patterns of holes or other optically recognizable indicia), compact disc read only memory (CD-ROM), compact disc-rewritable (CD-RW), digital versatile disc (DVD), Blu-ray disc (BD), any other non-transitory optical medium, and/or the like. Such a non-volatile computer-readable storage medium may also include read-only memory (ROM), programmable read-only memory (PROM), erasable programmable read-only memory (EPROM), electrically erasable programmable read-only memory (EEPROM), flash memory (e.g., Serial, NAND, NOR, and/or the like), multimedia memory cards (MMC), secure digital (SD) memory cards, SmartMedia cards, CompactFlash (CF) cards, Memory Sticks, and/or the like. Further, a non-volatile computer-readable storage medium may also include conductive-bridging random access memory (CBRAM), phase-change random access memory (PRAM), ferroelectric random-access memory (FeRAM), non-volatile random-access memory (NVRAM), magnetoresistive random-access memory (MRAM), resistive random-access memory (RRAM), Silicon-Oxide-Nitride-Oxide-Silicon memory (SONOS), floating junction gate random access memory (FJG RAM), Millipede memory, racetrack memory, and/or the like.

In one embodiment, a volatile computer-readable storage medium may include random access memory (RAM), dynamic random access memory (DRAM), static random access memory (SRAM), fast page mode dynamic random access memory (FPM DRAM), extended data-out dynamic random access memory (EDO DRAM), synchronous dynamic random access memory (SDRAM), double data rate synchronous dynamic random access memory (DDR SDRAM), double data rate type two synchronous dynamic random access memory (DDR2 SDRAM), double data rate type three synchronous dynamic random access memory (DDR3 SDRAM), Rambus dynamic random access memory (RDRAM), Twin Transistor RAM (TTRAM), Thyristor RAM (T-RAM), Zero-capacitor (Z-RAM), Rambus in-line memory module (RIMM), dual in-line memory module (DIMM), single in-line memory module (SIMM), video random access memory (VRAM), cache memory (including various levels), flash memory, register memory, and/or the like. It will be appreciated that where embodiments are described to use a computer-readable storage medium, other types of computer-readable storage media may be substituted for or used in addition to the computer-readable storage media described above.

As should be appreciated, various embodiments of the present invention may also be implemented as methods, apparatus, systems, computing devices, computing entities, and/or the like. As such, embodiments of the present invention may take the form of an apparatus, system, computing device, computing entity, and/or the like executing instructions stored on a computer-readable storage medium to perform certain steps or operations. Thus, embodiments of the present invention may also take the form of an entirely hardware embodiment, an entirely computer program product embodiment, and/or an embodiment that comprises combination of computer program products and hardware performing certain steps or operations.

Embodiments of the present invention are described below with reference to block diagrams and flowchart illustrations. Thus, it should be understood that each block of the block diagrams and flowchart illustrations may be implemented in the form of a computer program product, an entirely hardware embodiment, a combination of hardware and computer program products, and/or apparatus, systems, computing devices, computing entities, and/or the like carrying out instructions, operations, steps, and similar words used interchangeably (e.g., the executable instructions, instructions for execution, program code, and/or the like) on a computer-readable storage medium for execution. For example, retrieval, loading, and execution of code may be performed sequentially such that one instruction is retrieved, loaded, and executed at a time. In some exemplary embodiments, retrieval, loading, and/or execution may be performed in parallel such that multiple instructions are retrieved, loaded, and/or executed together. Thus, such embodiments can produce specifically-configured machines performing the steps or operations specified in the block diagrams and flowchart illustrations. Accordingly, the block diagrams and flowchart illustrations support various combinations of embodiments for performing the specified instructions, operations, or steps.

IV. Conclusion

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A magnetic-field-guidance system comprising:

a workpiece holder configured to (a) be secured to a base and (b) secure a workpiece relative to the base;

one or more tooling magnets each comprising a finishing tip; and one or more flexible bags containing magnetic media (a) disposed on an opposite side of the workpiece relative to the one or more tooling magnets and (b) in collaboration with the tooling magnets, direct a magnetic field which thereby guides a magnetic-abrasive slurry to finish the workpiece using Magnetic Abrasive Finishing (MAF).

2. The magnetic-field-guidance system of claim 1, wherein the magnetic media comprises at least one of (a) magnetic linked rings, (b) magnetic unlinked rings, (c) magnetic spheres, (d) magnetic flakes, (e) magnetic powders, (f) short wires, or (g) pins.

3. The magnetic-field-guidance system of claim 1, wherein the workpiece holder comprises a peripheral support, defining a cavity and the one or more flexible bags are disposed within the cavity.

4. The magnetic-field-guidance system of claim 3, wherein the workpiece holder further comprises (a) a seat configured to have the workpiece rest thereon and (b) a clamping component configured to hold the workpiece engaged to the seat.

5. The magnetic-field-guidance system of claim 1, wherein the workpiece holder is a jig for serial use with a variety of workpieces.

6. The magnetic-field-guidance system of claim 1, wherein a distance between the workpiece and each of the one or more flexible bags may be adjusted prior to or during the Magnetic Abrasive Finishing.

7. The magnetic-field-guidance system of claim 1, further comprising a vacuum pump operatively secured to a first bag of the one or more flexible bags, the vacuum pump configured to adjust a volume of the first bag by adding or removing air from an interior of the first bag.

8. The magnetic-field-guidance system of claim 7, further comprising a control system in communication with the vacuum pump and configured to cause select operation of the vacuum pump to adjust the volume of the first bag.

9. The magnetic-field-guidance system of claim 1, wherein (a) a peripheral support of the workpiece holder, the base, and the workpiece define a cavity having a cavity volume and (b) the one or more flexible bags defines a bag volume and shape.

10. The magnetic-field-guidance system of claim 9, wherein the bag volume is less than the cavity volume.

11. The magnetic-field-guidance system of claim 9, wherein at least one of the bag shape, volume, or position is adjustable.

12. The magnetic-field-guidance system of claim 9, wherein at least one of the bag volume or shape is constrained by the cavity.

13. The magnetic-field-guidance system of concept 1, wherein an air gap exists between the workpiece and the one or more flexible bags.

14. The magnetic-field-guidance system of concept 13, wherein a dimension or volume of the air gap is adjustable.

* * * * *